US006308842B1

(12) United States Patent
Robbins, III et al.

(10) Patent No.: US 6,308,842 B1
(45) Date of Patent: Oct. 30, 2001

(54) RETAIL DISPLAY SYSTEM FOR A DESK CHAIRMAT WITH HANDLES AND HANG TABS

(75) Inventors: Edward S. Robbins, III, 128 Hazelwood La., Florence, AL (US) 35630; John D. Carlton, Florence; Gary L. House, Rogersville, both of AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 0 days.

(21) Appl. No.: 09/684,913

(22) Filed: Oct. 10, 2000

(51) Int. Cl.[7] ..... A47F 7/00

(52) U.S. Cl. ..... 211/113; 211/45; 211/204; 211/206; 206/494

(58) Field of Search ..... 211/113, 13.1, 211/45, 46, 204, 206; 206/494, 784, 472

(56) References Cited

U.S. PATENT DOCUMENTS

| | | | | |
|---|---|---|---|---|
| D. 49,664 | | 9/1916 | Farmer . | |
| D. 186,517 | | 11/1959 | Walsh et al. . | |
| D. 247,532 | | 3/1978 | Tenney . | |
| D. 252,779 | | 9/1979 | Mogelhoj . | |
| D. 327,993 | | 7/1992 | Brunner . | |
| D. 345,908 | * | 4/1994 | Wallach . | |
| 1,706,069 | * | 3/1929 | Manquardt . | |
| 3,172,539 | | 3/1965 | Rulf . | |
| 3,323,151 | | 6/1967 | Lerman . | |
| 3,532,224 | | 10/1970 | Grubb et al. . | |
| 3,568,852 | * | 3/1971 | Howard | 211/113 |
| 3,841,478 | * | 10/1974 | Wells et al. . | |
| 3,905,480 | * | 9/1975 | Grinceri | 211/45 |
| 3,984,002 | * | 10/1976 | Howard | 211/45 |
| 4,190,151 | * | 2/1980 | Russell . | |
| 4,361,241 | | 11/1982 | Stoddard . | |
| 4,370,767 | | 2/1983 | Fraser . | |
| 4,476,174 | | 10/1984 | Carrera . | |
| 4,491,894 | * | 1/1985 | Pitts . | |
| 4,574,101 | | 3/1986 | Tricca et al. . | |
| 4,724,967 | | 2/1988 | Valiulis . | |
| 4,784,888 | | 11/1988 | Schwertner et al. . | |
| 4,926,512 | | 5/1990 | Coyle . | |
| 4,940,620 | | 7/1990 | Silk et al. . | |
| 5,059,476 | | 10/1991 | Steiniger et al. . | |
| 5,073,428 | | 12/1991 | Lancelot et al. . | |
| 5,190,200 | | 3/1993 | Hammerlund . | |
| 5,257,694 | * | 11/1993 | Wallach . | |
| 5,303,830 | | 4/1994 | Metcalf . | |
| 5,425,444 | | 6/1995 | Chapman . | |
| 5,439,405 | | 8/1995 | Storey et al. . | |
| 5,462,178 | * | 10/1995 | Wallach et al. . | |
| 5,577,730 | | 11/1996 | Vannozzi, Sr. . | |
| 5,740,928 | | 4/1998 | Dale et al. . | |
| 5,860,239 | | 1/1999 | Thalenfeld et al. . | |
| 5,916,658 | | 6/1999 | Mohr . | |
| 6,177,165 | * | 1/2001 | Robbins et al. . | |
| 6,183,833 | * | 2/2001 | Robbins et al. . | |

* cited by examiner

*Primary Examiner*—Robert W. Gibson, Jr.
(74) *Attorney, Agent, or Firm*—Nixon & Vanderhye P.C.

(57) ABSTRACT

A retail display system for a desk chairmat includes a display stand having at least one support component thereon. A desk chairmat having a longitudinal fold line, is folded in half about the fold line and a wrap extends about the chairmat in the folded condition. The chairmat is suspended from the support component. In another embodiment, the retail display system comprises a display stand including a pair of vertical standards and one or more horizontal reinforcing rods; at least two laterally spaced support components mounted on the display stand; a desk chairmat having four side edges, with a pair or hang tabs laterally spaced along one of the side edges; wherein the desk chairmat is suspended from the support components by the hang tabs.

17 Claims, 6 Drawing Sheets

RETAIL DISPLAY SYSTEM FOR A DESK CHAIRMAT WITH HANDLES AND HANG TABS

TECHNICAL FIELD

This invention relates to desk chairmats and specifically, to a retail display system for chairmats typically used under desk chairs.

BACKGROUND

Desk chairmats for office and home use are well known. Such chairmats typically have a main portion on which the desk chair rolls, and a forward lip portion which is adapted to extend partially under the desk well, and on which the feet of the person sitting in the chair may rest. Desk chairmats which are to be applied over carpeting typically have short but relatively sharp spikes on the undersides thereof which hold the mats firmly in place.

The above discribed desk chairmats, and particularly those with spikes, are difficult to carry and/or otherwise handle due to their relatively large size and the semi-rigid nature of the material from which they are formed. Unless the chairmat is boxed or otherwise protected, the user typically carries the chairmat by gripping about one or two of the edges of the chairmat, often resulting in irritation if not injury to the hands, due to the spikes projecting from the underside of the chairmat.

Some attempts have been made to solve the problem, but only to the extent of making the chairmats foldable to thereby reduce their size for handling purposes. See, for example. U.S. Pat. No. 5,073,428 and commonly owned U.S. Pat. No. 4,784,888.

For the most part, desk chairmats have been sold at office supply stores or distributors as opposed to retail stores, so that to some extent, the handling problem was alleviated by boxing the chairmats individually or in groups prior to shipping. However, even when supplied from a distributor in boxed form, the end user has to remove the chairmat from the box and carry it to its final destination, again, with some difficulty due to the physical attributes of the chairmat. In any event. chairmats are now being found increasingly in retail outlets, compounding the problem and while it is recognized that the chairmats may be boxed, the fact is that boxes add cost and are themselves unwieldy, and are therefore not likely to be used to any great extent in the retail environment. Thus, with increasing retail activity, new displays are also required. Conventional chairmats, because of their bulky and somewhat unwieldy configuration, present display problems since, absent the use of boxes, they do not stand alone unless wound. Even standing on edge in a wound or partially wound state, however, the mats are relatively unstable and, in any event, this is not a viable display arrangement.

Accordingly, there remains a need for a solution to the problem of transporting desk chairmats easily and safely, particularly those chairmats which have carpet spikes, and to the problem of displaying and stocking chairmats in a retail environment.

SUMMARY OF THE INVENTION

This invention relates to a retail display system for desk chairmats. In accordance with this invention, desk chairmats with handles and hang tabs are disclosed which solve the handling problem, and which can be later removed by the purchaser with, for example, a pair of scissors, knife or the like. The desk chairmats are also formed with fold lines, enabling the chairmats to be folded in half, wrapped, and suspended from a display stand from which they can be easily removed and carried away by the customer.

Specifically, in a first exemplary embodiment, integral handles are molded in place on opposite sides of the chairmat. With this arrangement, the chairmat may be folded in half (with the carpet spikes facing inwardly) so that the two handles align, thereby not only reducing the profile of the chairmat, but also forming a single stronger handle enabling the user to carry the chairmat without difficulty.

It is another feature of the invention to include one or more integral hang tabs along one or more sides of the chairmat to facilitate display, particularly in a retail environment. The tab may be in the form of an integral, solid tab with a hole sized to fit over a display hook. With a pair of such hang labs on opposite sides of the fold line, these tabs also align when the chairmat is folded, enabling the mat to be hung from both tabs.

It is another feature of the invention to include a longitudinal groove on one or both sides of the mat, extending midway between and parallel to those edges on which the handles are located, thereby providing an integral hinge, facilitating the folding of the chairmat and the bringing of the handles into engagement, to thereby permit easier transport due to the reduced profile of the chairmat.

The invention also relates to a wrap for holding the chairmat in the folded condition, further facilitating display and transport of the chairmat.

The invention also provides a display rack or stand by which several of the above described chairmats can be suspended for display and removal in a retail environment.

Accordingly, in its broader aspects, the present invention relates to a retail display system for a desk chairmat comprising a display stand having at least one support component thereon; a desk chairmat having a longitudinal fold line, the chairmat folded in half about the fold line; a wrap extending about the chairmat in the folded condition; and wherein the chairmat is suspended from the support component.

In another aspect, the invention relates to a retail display system for a desk chairmat comprising a display stand having a pair of vertical standards and a display rod having at least one hook thereon; a desk chairmat having a longitudinal fold line, the chairmat folded in half about the fold line wherein the chairmat is provided with a pair of handles on first and second opposite side edges thereof, such that the handles are aligned when the chairmat is folded; a wrap extending about the folded chairmat perpendicularly to the fold line; wherein the chairmat is provided with at least one hang tab along a third edge thereof, and wherein the chairmat is suspended from at least one hook by the hang tab; and wherein an underside of the desk chairmat is formed with integral spikes that face inwardly when the chairmat is in the folded condition.

Additional features and advantages of the subject invention will become apparent from the detailed description which follows.

BEST MODE FOR CARRYING OUT THE INVENTION

Figure 1:
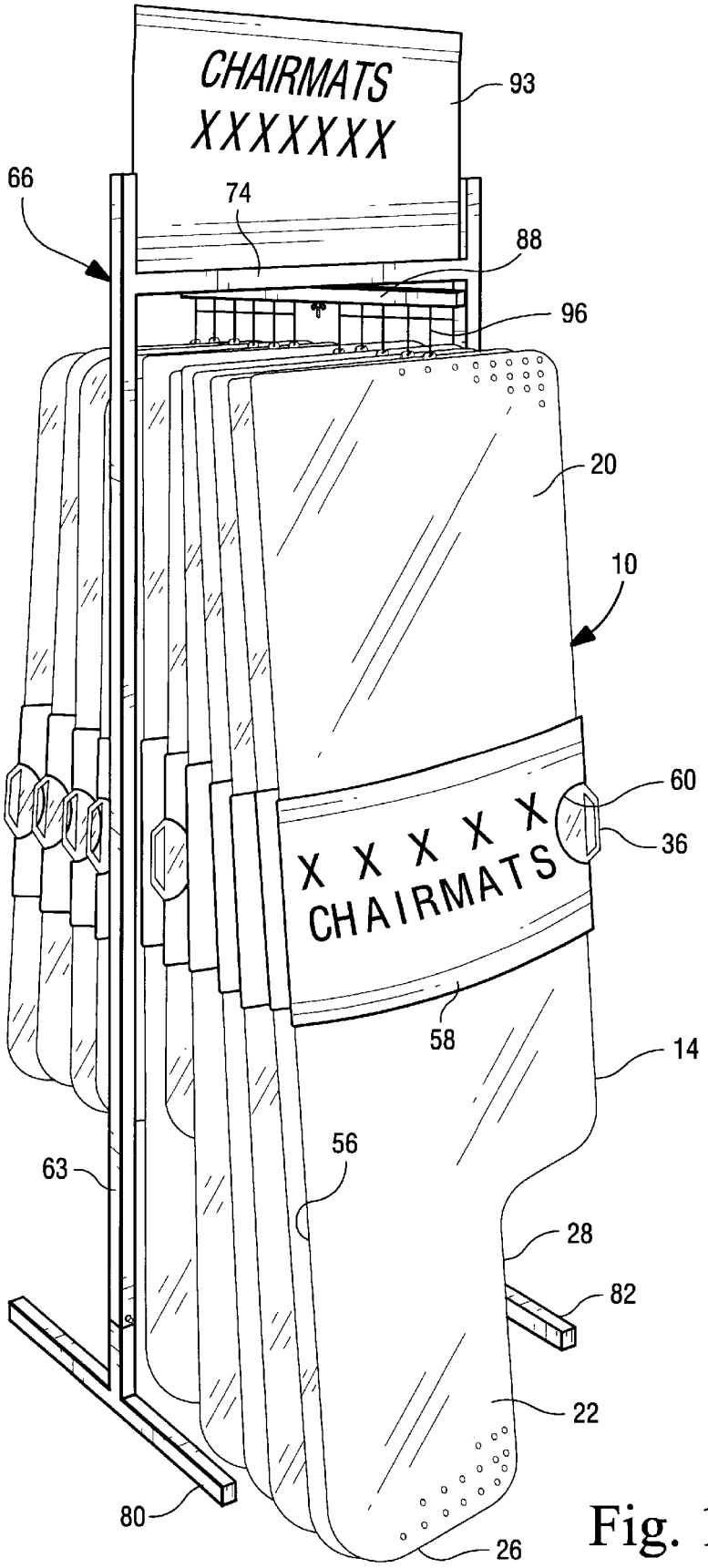
FIG. 1 is a perspective view of chairmats suspended from a display stand in accordance with the invention.
Figure 2:
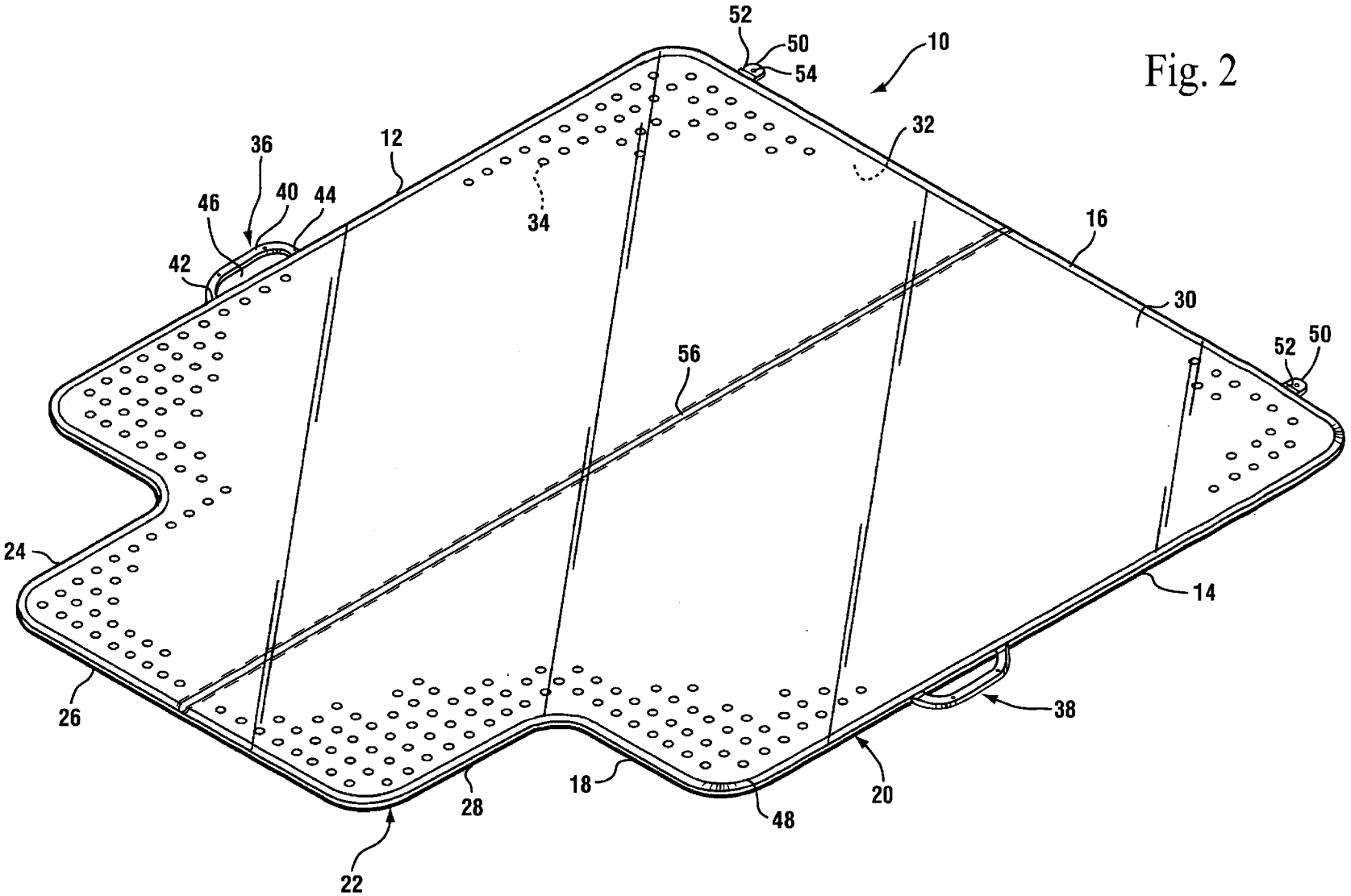
FIG. 2 is a perspective view of a chairmat of the type shown in FIG. 1, but in an unfolded condition.

FIG. 1 illustrates a plurality of folded desk chairmats 10 suspended from a display stand 66, in a retail display system as described in greater detail below. Referring now to FIG. 2, the desk chairmat 10 includes a planar, semi-rigid member (made from, e.g., PVC, polypropylene, semi-rigid vinyl or other suitable material) having four side edges 12, 14, 16 and 18. which define a major portion 20 of the chairmat. An optional lip extension portion 22 of the same material and thickness, projects or extends integrally from side edge 18, and is further defined by edges 24, 26, 28. The lip extension 22, as is well known, is designed to project into the well area of a desk, with the remainder of the chairmat behind the desk and serving as the principal contact area for a desk chair (not shown) typically (but not necessarily) fitted with rollers or casters. The chairmat need not have a lip extension of this type, however. The upper surface 30 of the chairmat is generally smooth, while the lower surface 32 may be formed with a substantial number of relatively short but relatively sharp spikes 34 which are used to anchor the chairmat to an underlying carpet. As is well understood in the art, chairmats for use on hard flooring do not require such spikes.

In accordance with an exemplary embodiment of this invention, the chairmat 10 is formed with a pair of integral handles 36, 38 which project from opposite side edges 12 and 14, i.e., the handles lie outside the periphery of the chairmat. While the location of the handles can vary (e.g., the handles could be formed by cut-outs within the mat itself), placing them along the longer sides of the chairmat is preferred. It is also advantageous to locate the handles in alignment with the center of mass of the chairmat so that the latter is balanced when gripped by the aligned handles. Since the handles 36, 38 are identical, only one need be described in detail.

Handle 36 comprises a loop 40 connected at opposite ends thereof to the edge 12 along a pair of webs 42, 44, each of which having a width of about ⅜", but this dimension may vary. The loop 40 is arranged to form a handle opening 46. Note also that in the presently described embodiment, the chairmat may be formed with an otherwise known ramp or tapered marginal edge 48 which extends about the entire periphery of the chairmat. Thus, where the handle loop 40 is joined to the edge 12 along the pair of webs 42, 44. The handle loop thickness may be the same as (but is preferably less than) the maximum thickness of the chairmat. This arrangement results in a handle which is easily cut away from the mat. The invention here, however, is not limited to any particular handle design.

The chairmat as described above is also disclosed in commonly owned co-pending application Ser. No. 09/238,737 filed Jan. 28, 1999. The above described chairmat constructions can be made in accordance with various known plastic forming techniques including stamping of preformed sheets. The preferred technique, however, is as described generally in commonly owned U.S. Pat. No. 5,213.741 and currently pending application Ser. No. 09/110,205 filed Jul. 6, 1998.

Note that while the pair of handles 36, 38 are preferably located on opposite sides, a single handle on one side only may be used as well. In addition, the one or two handles can be located along any of the side edges of the chairmat. It is preferred, however, that the handles be located along the longitudinal side edges 12, 14 (as opposed to the transverse edges) that are parallel to the longitudinal fold line described further below, to facilitate carrying of the chairmat. Moreover, the shape of the handle, i.e., arcuate, rectangular, etc. may also be varied as desired.

It is another feature of this invention to include one or more hang tabs 50 along one or more side edges of the chairmat. FIG. 2 shows a preferred arrangement where two such hang tabs are located along side edge 16. The tab 50 is a solid protrusion or projection integrally formed with the mat, and may be connected along a thinned web 52 (similar to web 44 associated with handles 36, 38), to facilitate removal of the tabs after purchase. Tabs 50 are formed with holes or apertures 54 which enable the mat to be suspended from display hooks or the like.

In a variation of this design, one or more small holes (not shown) may be formed within the periphery of the mat, e.g., to the inside of edge 16, to facilitate hanging from a retail display stand. In any event, the invention is not limited to any particular hang tab design.

A fold line is provided in the form of a first elongated U-shaped groove 56 in the top surface 30 of the mat. The groove 56 is about 0.125 inch wide and has a depth of about 0.080 inch, leaving a thinned web or "living hinge" having a thickness of about 0.020 inch. It is preferable that the groove 56 extend substantially the full length of the mat terminating immediately adjacent or through the tapered ramp 48.

In an alternative groove configuration, aligned grooves (not shown) may be formed in both the upper and lower surfaces of the mat, leaving a thin residual web between the grooves, providing easy folding.

Figure 3:
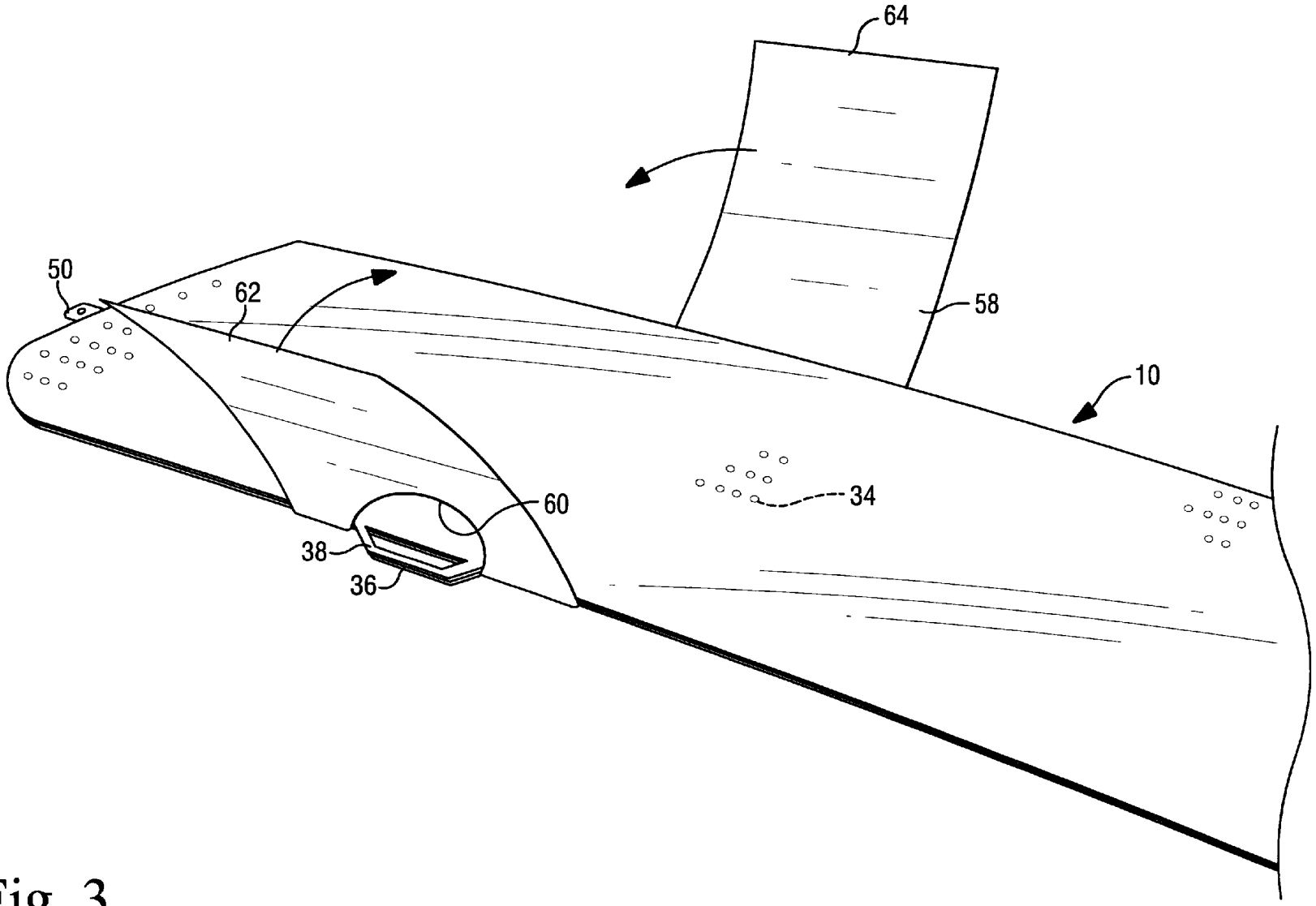
FIG. 3 is a partial perspective view of a folded chairmat indicating how the folded chairmat is wrapped in accordance with the invention.

Referring now to FIG. 3, after the chairmat 10 is folded in half, a wrap 58 of plastic film, cardboard, paper board or other suitable material, is applied to the middle of the folded chairmat to hold the latter in the folded condition. The wrap 58 is formed with a hole or cut-out 60 that allows the wrap to accommodate the aligned but projecting handles 36, 38. Free ends 62 and 64 of the wrap are then overlapped and adhesively secured. Of course, suitable advertising and other information may be applied to the wrap 58.

Figure 4:
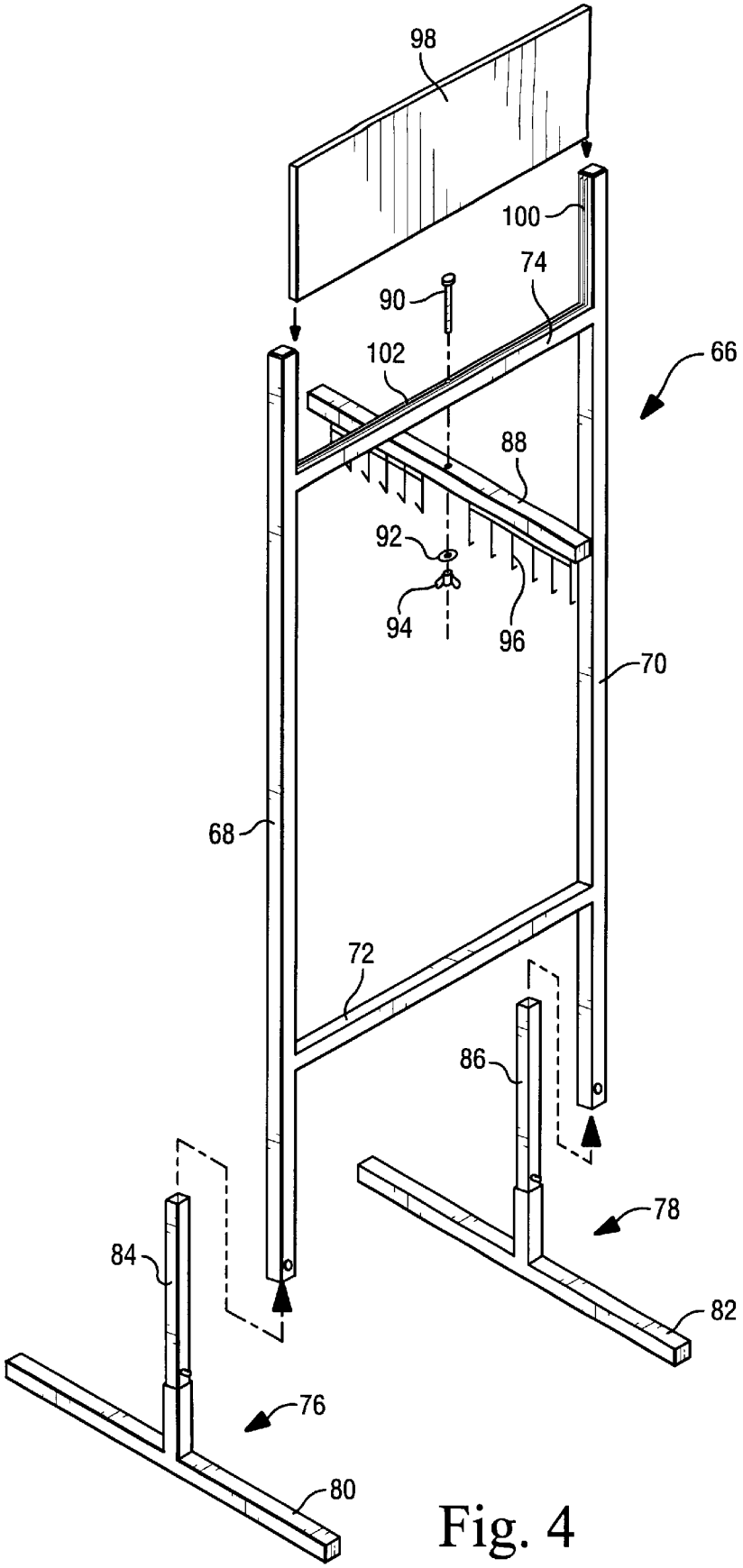
FIG. 4 is an exploded view of the display stand shown in FIG. 1.

FIG. 4 discloses an exemplary stand-alone, display stand 66 by which the above described chairmat may be displayed for retail purchase. A pair of vertical standards 68, 70, braced by horizontal reinforcement rods 72, 74 are supported on a pair of leg assemblies 76, 78, respectively. The latter include horizontal feet 80, 82 and vertical extensions 84, 86 that are telescoped within the lower ends of standards 68, 70, and secured, if desired, by a conventional detent mechanism.

A horizontal display rod 88 is fixed to reinforcement rod 74, perpendicularly thereto, using a conventional bolt 90, washer 92 and wing nut 94. A number of display hooks 96 are fixed to the display rod 88 by any suitable means.

An advertising panel 98 may be added between the standards 68, 70, above the rod 74, and held within, for example, grooves 100, 102 or other suitable means.

Utilizing the aligned hang tabs 50, several folded and wrapped chairmats 10 may be suspended from the hooks 96 as shown in FIG. 1, thus providing a convenient retail display from which the purchaser may remove and carry away one or more of the chairmats.

Figure 5:
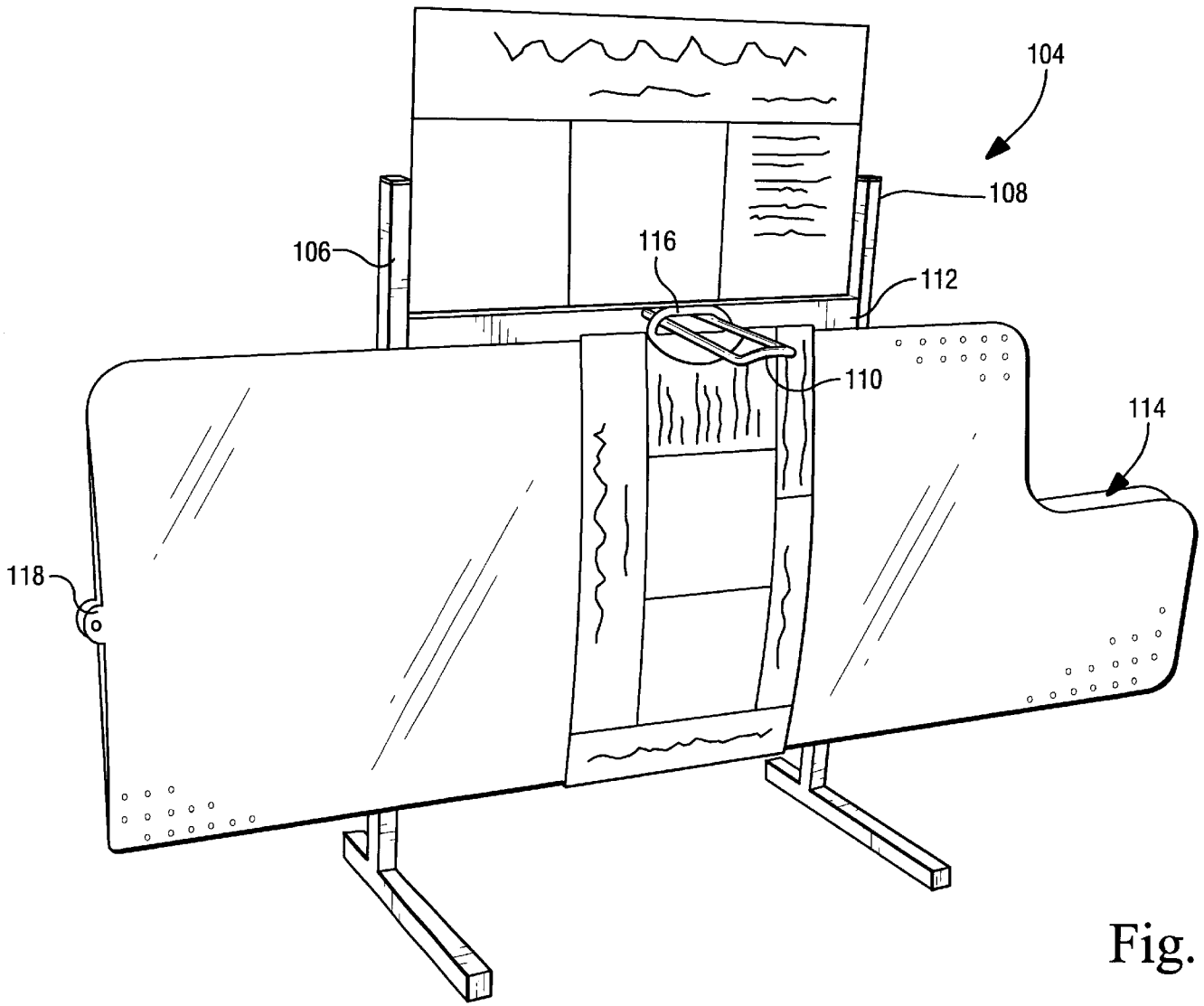
FIG. 5 is a perspective view of a chairmat suspended from an alternative display stand, with the chairmat oriented horizontally.
Figure 6:
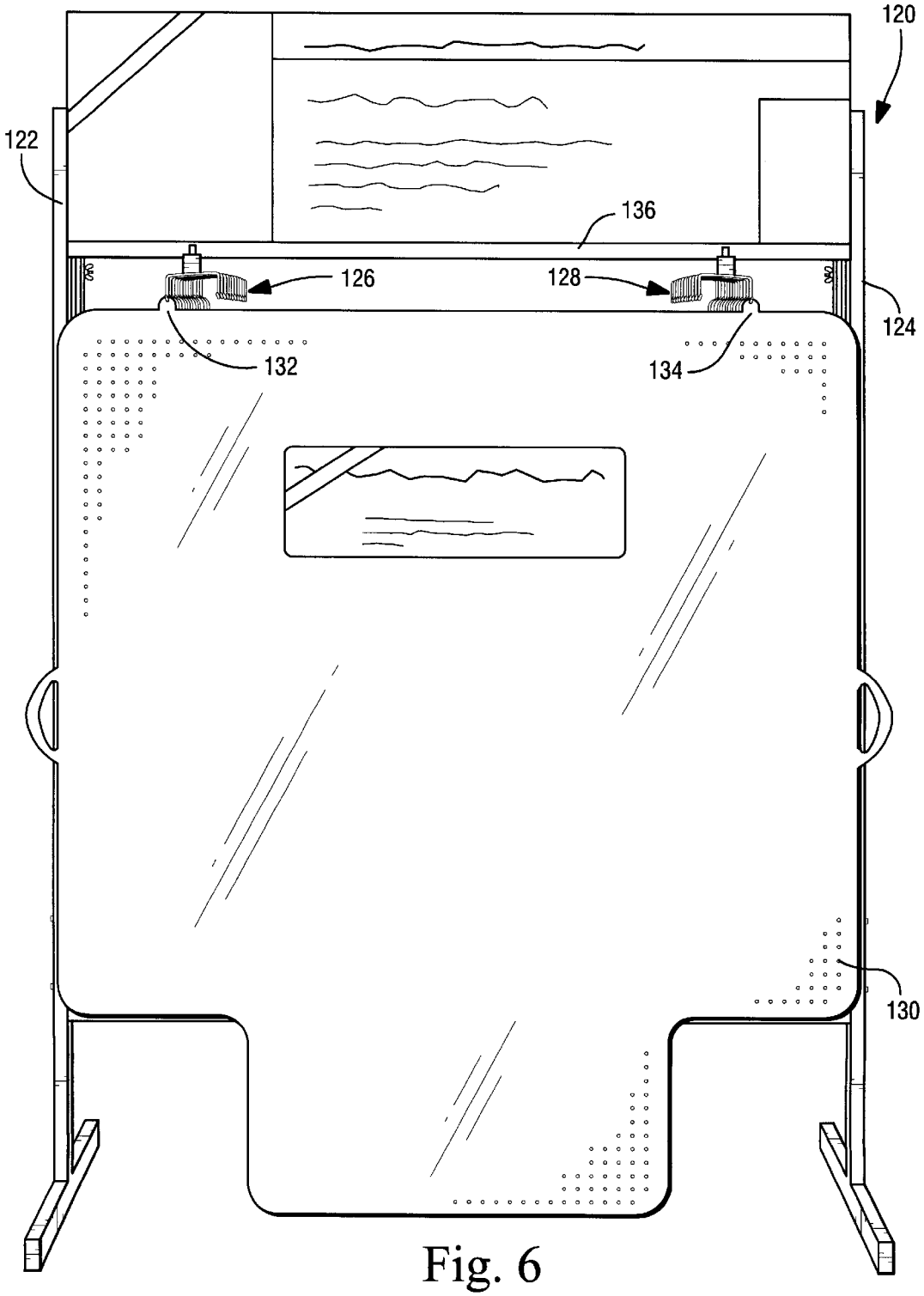
FIG. 6 is a perspective view of a non-foldable chairmat suspended from still another display stand in accordance with the invention.

It will be appreciated that other display stand configurations may be employed. FIGS. 5 and 6 illustrate other exemplary display stands for supporting desk chairmats as described herein. In FIG. 5, a display stand 104 is illustrated wherein the vertical standards 106 and 108 have been shortened to create a lower profile stand. A support bracket 110 extends away from the horizontal reinforcement rod 112 and allows one or more folded chairmats 114, similar to those described above, to be suspended from the integral pair of handles 116 (as opposed to the integral hang tabs 118). In this way, the chairmat 114 can be oriented horizontally, providing flexibility in the choice of retail displays.

FIG. 6 illustrates another exemplary display stand 120, wherein the vertical standards 122, 14 have a height similar to the stand shown in FIG. 1, but have been spaced a greater distance apart so that one or more chairmats 130, similar to those described above without a folding groove, can be suspended from dual rows of support hooks 126, 128 by integral hang tabs 132, 134. Of course, chairmats incorporating a folding groove could also be suspended in this manner. The support hooks are secured to the horizontal reinforcement rod 136.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A retail display system for a desk chairmat comprising:

a display stand having at least one support component thereon;

a desk chairmat having a longitudinal fold line, said chairmat folded in half about said fold line;

a wrap extending about said chairmat in the folded condition; and wherein said chairmat is suspended from said at least one support component.

2. The retail display system of claim 1 wherein said chairmat is provided with a pair of handles on first and second opposite side edges thereof, such that said handles are aligned when the chairmat is in the folded condition, and wherein said wrap extends perpendicularly to said fold line, with a cut-out through which said handles extend.

3. The retail display system of claim 1 wherein said chairmat is provided with at least one hang tab along one edge thereof, and wherein said chairmat is suspended from said at least one support component by said hang tab.

4. The retail display system of claim 1 wherein said chairmat is provided with at least one hang tab along another edge thereof, and wherein said chairmat is suspended from said at least one support component by said hang tab.

5. The retail display system of claim 1 wherein first and second hang tabs are provided on an edge such that said hang tabs are aligned when said chairmat is in the folded condition, and further wherein said chairmat is suspended from both said first and second hang tabs.

6. The retail display system of claim 1 wherein an underside of said desk chairmat is formed with integral spikes that face inwardly when the chairmat is in the folded condition.

7. The retail display system of claim 1 wherein said display stand includes a plurality of support components for suspending a respective plurality of chairmats.

8. The retail display system of claim 1 wherein said chairmat is oriented such that said fold line extends horizontally.

9. The retail display system of claim 1 wherein said chairmat is oriented such that said fold line is oriented vertically.

10. The retail display system of claim 9 wherein said chairmat is provided with a pair of handles along opposite side edges thereof, and wherein said chairmat is suspended from said at least one support component by said pair of handles.

11. A retail display system for a desk chairmat comprising:

a display stand having a pair of vertical standards and a horizontal rod having at least one hook thereon;

a desk chairmat having a longitudinal fold line, said chairmat folded in half about said fold line wherein said chairmat is provided with a pair of handles along first and second opposite side edges thereof, such that said handles are aligned when the chairmat is folded;

a wrap extending about said folded chairmat perpendicularly to said fold line;

wherein said chairmat is provided with at least one hang tab along a third edge thereof, and wherein said chairmat is suspended from said at least one hook by said hang tab; and wherein an underside of said desk chairmat is formed with integral spikes that face inwardly when the chairmat is in the folded condition.

12. The retail display system of claim 11 wherein said pair of vertical standards are braced by upper and lower reinforcing rods and wherein said display rod is fixed to said upper reinforcing rod substantially perpendicular thereto.

13. The retail display system of claim 12 and including an advertising panel between said vertical standards, above said display rod.

14. The retail display system of claim 11 wherein a pair of hang tabs are provided on another edge of said chairmat such that said tabs are aligned when said chairmat is in the folded condition, and further wherein said chairmat is suspended from said at least one hook by said pair of hang tabs.

15. The retail display system of claim 11 wherein said wrap is formed with a cut-out through which said handles extend.

16. A retail display system for a desk chairmat comprising:

a display stand including a pair of vertical standards and one or more horizontal reinforcing rods; at least two laterally spaced support components mounted on said display stand;

a desk chairmat having four side edges, with a pair of hang tabs laterally spaced along one of said side edges; wherein said desk chairmat is suspended from said support components by said hang tabs.

17. The retail display system of claim 16 wherein said desk chairmat is also provided with a pair of handles along opposite side edges, respectively, said opposite side edges not including said one of said side edges.

* * * * *